US005812103A

United States Patent [19]

Choy

[11] Patent Number: 5,812,103

[45] Date of Patent: Sep. 22, 1998

[54] HIGH VOLTAGE OUTPUT CIRCUIT FOR DRIVING GRAY SCALE FLAT PANEL DISPLAYS AND METHOD THEREFOR

[75] Inventor: Benedict C. K. Choy, Saratoga, Calif.

[73] Assignee: Supertex, Inc., Sunnyvale, Calif.

[21] Appl. No.: 570,424

[22] Filed: Dec. 11, 1995

[51] Int. Cl.[6] ..... G09G 3/00

[52] U.S. Cl. ..... 345/63; 345/77; 345/89; 345/211; 345/147; 326/80

[58] Field of Search ..... 327/333; 326/63–71, 326/76, 80, 81; 345/147, 148, 89, 63, 94, 77, 96, 204, 208, 206, 209, 211

[56] References Cited

U.S. PATENT DOCUMENTS

| | | | |
|---|---|---|---|
| 3,835,457 | 9/1974 | Yu | 326/70 |
| 4,963,860 | 10/1990 | Stewart | 345/206 |
| 5,225,721 | 7/1993 | Gal et al. | 326/71 |
| 5,304,869 | 4/1994 | Greason | 326/66 |
| 5,465,054 | 11/1995 | Erhart | 326/81 |
| 5,477,234 | 12/1995 | Suzuki et al. | 345/98 |
| 5,489,918 | 2/1996 | Mosier | 345/89 |

*Primary Examiner*—Lun-Yi Lao
*Attorney, Agent, or Firm*—Harry M. Weiss; Jeffrey D. Moy; Harry M. Weiss & Associates, P.C.

[57] ABSTRACT

The present invention relates to a high voltage output circuit for driving a gray scale flat panel display. The high voltage output circuit eliminates the inaccuracies of prior art output circuits by using a plurality of transistors to eliminate a dead band level within the output circuit. The output circuit is also less expensive than prior art output circuits since a level translator is not required.

17 Claims, 1 Drawing Sheet

HIGH VOLTAGE OUTPUT CIRCUIT FOR DRIVING GRAY SCALE FLAT PANEL DISPLAYS AND METHOD THEREFOR

BACKGROUND OF THE INVENTION

1. Field of the Invention

This invention relates to high voltage output circuits and, more specifically, to a high voltage output circuit for driving gray scale flat panel displays.

2. Description of the Prior Art

In many flat panel displays, in order to generate a gray scale output, it is desirable to use amplitude modulation. In some cases amplitude modulation may be the only acceptable method for generating a gray scale output. Because of the large number of lines on a flat panel display which must be driven at high voltages, driver circuits for generating a gray scale output must be made inexpensively, with low power requirements, and with high accuracy.

One way of driving gray scale flat panel displays is to use a high voltage operational amplifier (hereinafter op amp) to drive each line of the flat panel display. While using an op amp may be fairly accurate, it does not meet the other requirements of being inexpensive with low power requirements.

Several companies have developed high voltage output circuits for driving gray scale flat panel displays. While these circuits do work for most applications, they needed to be improved to provide increased accuracy as will be discussed below.

Therefore, a need existed to provide an improved high voltage output circuit for driving gray scale flat panel displays. The improved high voltage output circuit must be inexpensive, have low power requirements, and have high accuracy.

SUMMARY OF THE INVENTION

In accordance with one embodiment of the present invention, it is an object of the present invention to provide an improved high voltage output circuit and method therefor for driving gray scale flat panel displays.

It is another object of the present invention to provide an improved high voltage output circuit and method therefor for driving gray scale flat panel displays which is inexpensive.

It is still another object of the present invention to provide an improved high voltage output circuit and method therefor for driving gray scale flat panel displays which has low power requirements.

It is a further object of the present invention to provide an improved high voltage output circuit and method therefor for driving gray scale flat panel displays which has high accuracy.

BRIEF DESCRIPTION OF THE PREFERRED EMBODIMENTS

In accordance with one embodiment of the present invention, a high voltage output circuit for driving a gray scale flat panel display is disclosed. The circuit is comprised of low voltage logic means for converting digitally coded gray scale data into pulse width coded data. Signal generating means are coupled to the low voltage logic means for generating a signal that is inversely proportional to a width of the pulse width coded data. Output circuit means are coupled to the signal generating means for sending an output signal to drive a line of the gray scale flat panel display. Transistor means are coupled to the output circuit means for eliminating a dead band level within the output circuit means.

In accordance with another embodiment of the present invention, a method for providing a high voltage output circuit for driving a gray scale flat panel display is disclosed. The method comprises the steps of: providing low voltage logic means for converting digitally coded gray scale data into pulse width coded data; providing signal generating means coupled to the low voltage logic means for generating a signal that is inversely proportional to a width of the pulse width coded data; providing output circuit means coupled to the signal generating means for sending an output signal to drive a line of the gray scale flat panel display; and providing transistor means coupled to the output circuit means for eliminating a dead band level within the output circuit means.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENT

Figure 1:
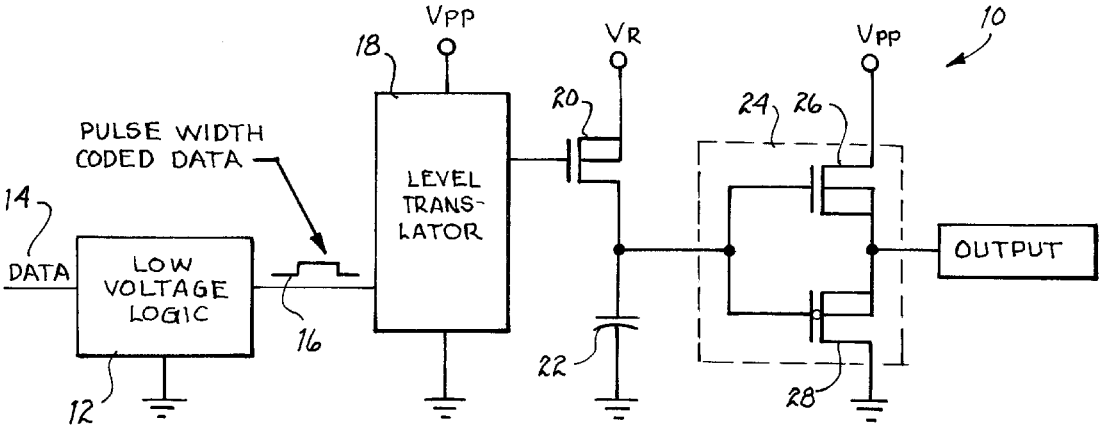
fig. 1 (PRIOR ART)
FIG. 1 is an electrical schematic of a prior art high voltage output circuit for driving gray scale flat panel displays.

Referring to FIG. 1, a prior art high voltage output circuit for driving gray scale flat panel displays 10 (hereinafter circuit 10) is shown. The circuit 10 is comprised of a low voltage logic circuit 12 which receives digital gray scale data 14 (usually 4 to 8 bits) and converts the data 14 into pulse width coded data 16 (hereinafter pulse 16). The pulse 16 is generated for each gray level with the width of the pulse 16 being proportional to the gray level. The pulse 16 is then fed to a level translator 18 which is used to amplify the pulse 16.

At the same time the pulse 16 is being inputted to the level translator 18, a ramping voltage $V_R$ is applied to a transistor 20. The transistor 20 has a gate which is coupled to the level translator 18. As the pulse 16 enters the level translator 18, the transistor 20 is turned on allowing the capacitor 22, which is coupled to the transistor 20, to be charged to a voltage equal to the ramping voltage $V_R$. When the pulse 16 is turned off, the transistor 20 is turned off thereby stopping the charging of the capacitor 22. The longer the width of the pulse 16, the longer the transistor 20 will be kept on, and the higher the capacitor 22 will be charged. Thus, the gray scale data 14, which was represented by the width of the pulse 16, is now changed to a voltage level which is stored in the capacitor 22. Thus, the voltage held in the capacitor 22 is proportional to the width of the pulse 16.

When the pulse 16 is in a low logic state, the transistor 20 is turned off and the charging of the capacitor 22 is stopped. The capacitor 22 will hold its voltage constant even though the ramping voltage $V_R$ may continue to rise.

An output circuit 24 is coupled to the capacitor 22. The output circuit 24 is a source follower driver output circuit wherein the output voltage follows the voltage of the capacitor 22. The output circuit is comprised of an N-channel transistor 26 having a gate which is coupled to a gate of a P-channel transistor 28.

While the circuit 10 has performed well for most applications, it needed to be improved to provide increased accuracy. The circuit 10 has two main sources of inaccuracies. First, because of the nature of the source follower output circuit 24, the output voltage is always one threshold voltage $V_T$ below the voltage stored in the capacitor 22. The threshold voltage $V_T$ may vary from run to run or from device to device. Therefore, device to device matching will suffer some inaccuracy. Second, since the N-channel transistor 26 and the P-channel transistor 28 are driven by the same voltage, a "dead band" equal to the sum of the threshold voltages $V_T$s of the N-channel transistor 26 and the P-channel transistor 28 exists at the output of the circuit 10.

Figure 2:
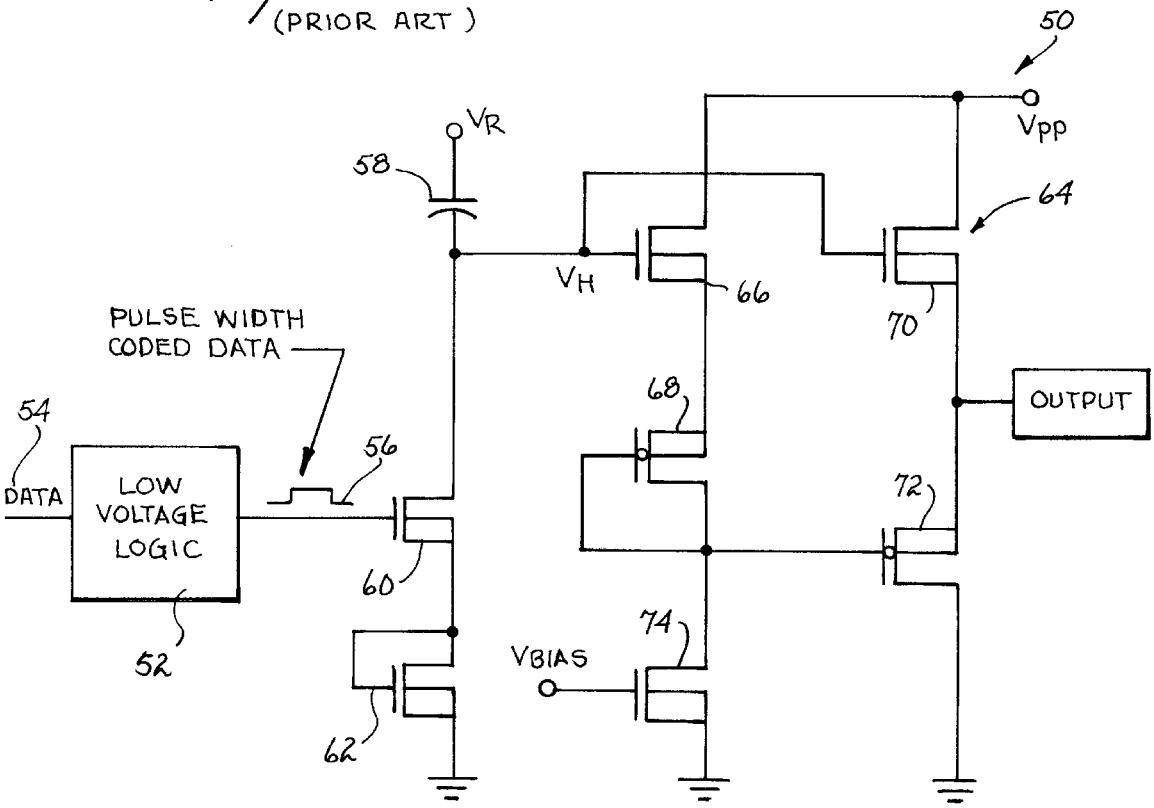
FIG. 2 is an electrical schematic of the high voltage output circuit for driving gray scale flat panel displays of the present invention.

Referring to FIG. 2, an improved high voltage output circuit for driving gray scale flat panel displays 50 (hereinafter circuit 50) is shown. The circuit 50 addresses the inaccuracy problem of the prior art circuit 10 (FIG. 1) while satisfying the low cost and low power requirements.

The circuit 50 is comprised of a low voltage logic circuit 52 which converts the digitally coded gray scale data 54 into a pulse width coded data 56 (hereinafter pulse 56). The pulse 56 turns on the transistor 60 which is coupled to a capacitor 58 and to another transistor 62. A ramping voltage $V_R$ is applied to the capacitor 58 at the same time the pulse 56 is inputted to the transistor 60. The pulse 56 turns on the transistor 60, however, the voltage at point $V_H$ will be held at the threshold voltage $V_T$ of the transistor 60 regardless of the value of the ramping voltage $V_R$. When the transistor 60 is turned off by the low state of the pulse 56, the voltage at point $V_H$ will ramp up at the same rate of the ramping voltage $V_R$. When the ramping voltage $V_R$ reaches its peak value, the voltage at $V_H$ will also reach its peak value. This eliminates the cross coupling of outputs of adjacent circuits 50 since the outputs of adjacent circuits 50 need to ramp up at the same rate and need to reach the peak voltage at the same time.

The longer the width of the pulse 56, the longer the voltage at point $V_H$ will be held at the threshold voltage $V_T$ before it starts to ramp up. Thus, the voltage at point $V_H$ is inversely proportional to the width of the pulse 56. It should be noted that the circuit 50 does not require a level translator 18 (FIG. 1) as does the prior art circuit 10 (FIG. 1) thereby reducing the cost of the circuit 50.

The point $V_H$ is coupled to an output circuit 64. The output circuit 64 is a source follower driver circuit which follows the voltage at point $V_H$. Since the voltage drop of transistor 66 and transistor 68 is equal to the sum of the threshold voltages $V_T$s of transistor 66 and transistor 68, which is also equal to the threshold voltages $V_T$s of transistor 70 and transistor 72, the output voltage to the gray scale flat panel display will not have a "dead band." Therefore, noise coupled to the output of the circuit 50 will not affect its value. It should also be noted that since the voltage at point $V_H$ starts ramping up from the threshold voltage $V_T$, the output voltage is independent of $V_T$. A transistor 74 is coupled to the output circuit 64. The transistor 74 provides a biasing current for transistors 66 and 68 which allows transistors 66 and 68 to set up the "dead band" cancellation.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A high voltage output circuit for driving a gray scale flat panel display comprising, in combination:

low voltage logic means for converting digitally coded gray scale data into pulse width coded data;

signal generating means coupled to said low voltage logic means for generating a signal that is inversely proportional to a width of said pulse width coded data;

output circuit means coupled to said signal generating means for sending an output signal to drive a line of said gray scale flat panel display; and semiconductor means coupled to said output circuit means for eliminating a dead band level within said output circuit means.

2. A high voltage output circuit for driving a gray scale flat panel display in accordance with claim 1 further comprising biasing means coupled to said semiconductor means for providing a biasing current to said semiconductor means for eliminating said dead band level within said output circuit means.

3. A high voltage output circuit for driving a gray scale flat panel display in accordance with claim 2 wherein said biasing means coupled to said semiconductor means for providing said semiconductor means with a biasing current for eliminating said dead band level within said output circuit means comprises a transistor having a drain coupled to said semiconductor means.

4. A high voltage output circuit for driving a gray scale flat panel display in accordance with claim 1 wherein said signal generating means for generating a signal that is inversely proportional to a width of said pulse width coded data comprises:

a first transistor coupled to said low voltage logic means;

a second transistor having a gate coupled to a source of said first transistor; and a capacitor coupled to a drain of said first transistor.

5. A high voltage output circuit for driving a gray scale flat panel display in accordance with claim 1 wherein said output circuit means for sending an output signal to drive a line of said gray scale flat panel display comprises:

a first transistor having a gate coupled to said signal generating means; and a second transistor having a source coupled to a source of said first transistor.

6. A high voltage output circuit for driving a gray scale flat panel display in accordance with claim 1 wherein said semiconductor means is a transistor means for eliminating said dead band level within said output circuit means.

7. A high voltage output circuit for driving a gray scale flat panel display in accordance with claim 6 wherein said transistor means is a metal oxide semiconductor (MOS) means for eliminating said dead band level within said output circuit means.

8. A high voltage output circuit for driving a gray scale flat panel display in accordance with claim 7 wherein said MOS means for eliminating said dead band level within said output circuit means further comprises:

a first transistor having a gate coupled to said signal generating means; and a second transistor having a source coupled to a source of said first transistor.

9. A high voltage output circuit for driving a gray scale flat panel display comprising, in combination:

low voltage logic means for converting digitally coded gray scale data into pulse width coded data;

signal generating means coupled to said low voltage logic means for generating a signal that is inversely proportional to a width of said pulse width coded data, said signal generating means comprising:

a first transistor coupled to said low voltage logic means, a second transistor having a gate coupled to a source of said first transistor, and a capacitor coupled to a drain of said first transistor;

output circuit means coupled to said signal generating means for sending an output signal to drive a line of said gray scale flat panel display, said output circuit means comprising:

a third transistor having a gate coupled to said signal generating means, and a fourth transistor having a source coupled to a source of said third transistor;

transistor means coupled to said output circuit means for eliminating a dead band level within said output circuit means, said transistor means comprising:

a fifth transistor having a gate coupled to said signal generating means, and a sixth transistor having a source coupled to a source of said fifth transistor; and biasing means coupled to said transistor means for providing a biasing current to said transistor means for eliminating said dead band level within said output circuit means.

10. A method for providing a high voltage output circuit for driving a gray scale flat panel display comprising the steps of:

providing low voltage logic means for converting digitally coded gray scale data into pulse width coded data;

providing signal generating means coupled to said low voltage logic means for generating a signal that is inversely proportional to a width of said pulse width coded data;

providing output circuit means coupled to said signal generating means for sending an output signal to drive a line of said gray scale flat panel display; and providing semiconductor means coupled to said output circuit means for eliminating a dead band level within said output circuit means.

11. The method of claim 10 further comprising the step of providing biasing means coupled to said semiconductor means for providing a biasing current to said semiconductor means for eliminating said dead band level within said output circuit means.

12. The method of claim 11 wherein said step of providing biasing means coupled to said semiconductor means for eliminating said dead band level within said output circuit means further comprises the step of providing a transistor having a drain coupled to said semiconductor means.

13. The method of claim 10 wherein said step of providing signal generating means for generating a signal that is inversely proportional to a width of said pulse width coded data further comprises the steps of:

providing a first transistor coupled to said low voltage logic means;

providing a second transistor having a gate coupled to a source of said first transistor; and providing a capacitor coupled to a drain of said first transistor.

14. The method of claim 10 wherein said step of providing output circuit means for sending an output signal to drive a line of said gray scale flat panel display further comprises the steps of:

providing a first transistor having a gate coupled to said signal generating means; and providing a second transistor having a source coupled to a source of said first transistor.

15. The method of claim 10 wherein said step of providing semiconductor means further comprises the step of providing transistor means for eliminating said dead band level within said output circuit means.

16. The method of claim 15 wherein said step of providing transistor means further comprises the step of providing metal oxide semiconductor (MOS) means for eliminating said dead band level within said output circuit means.

17. The method of claim 16 wherein said step of providing MOS means for eliminating said dead band level within said output circuit means further comprises the step of:

providing a first transistor having a gate coupled to said signal generating means; and providing a second transistor having a source coupled to a source of said first transistor.

* * * * *